US010683736B2

(12) United States Patent
Chen et al.

(10) Patent No.: US 10,683,736 B2
(45) Date of Patent: Jun. 16, 2020

(54) METHOD AND SYSTEM FOR RECOVERING GAS IN NATURAL GAS HYDRATE EXPLOITATION

(71) Applicant: GUANGZHOU INSTITUTE OF ENERGY CONVERSION, CHINESE ACADEMY OF SCIENCES, Guangzhou (CN)

(72) Inventors: Zhaoyang Chen, Guangzhou (CN); Xiaosen Li, Guangzhou (CN); Jinming Zhang, Guangzhou (CN); Yu Zhang, Guangzhou (CN); Gang Li, Guangzhou (CN); Qiunan Lv, Guangzhou (CN); Yi Wang, Guangzhou (CN); Kefeng Yan, Guangzhou (CN)

(73) Assignee: GUANGZHOU INSTITUTE OF ENERGY CONVERSION, CHINESE ACADEMY OF SCIENCES, Guangzhou (CN)

( * ) Notice: Subject to any disclaimer, the term of this patent is extended or adjusted under 35 U.S.C. 154(b) by 239 days.

(21) Appl. No.: 15/765,652

(22) PCT Filed: Feb. 12, 2018

(86) PCT No.: PCT/CN2018/076449
§ 371 (c)(1),
(2) Date: Apr. 3, 2018

(87) PCT Pub. No.: WO2019/134220
PCT Pub. Date: Jul. 11, 2019

(65) Prior Publication Data

US 2019/0211656 A1 Jul. 11, 2019

(30) Foreign Application Priority Data

Jan. 8, 2018 (CN) ..... 2018 1 0020818

(51) Int. Cl.
*E21B 43/12* (2006.01)
*E21B 43/34* (2006.01)
(Continued)

(52) U.S. Cl.
CPC ..... *E21B 43/122* (2013.01); *E21B 43/01* (2013.01); *E21B 43/168* (2013.01); *E21B 43/34* (2013.01); *E21B 2043/0115* (2013.01)

(58) Field of Classification Search
CPC ..... E21B 43/122; E21B 43/01; E21B 43/168; E21B 43/34; E21B 2043/0115
See application file for complete search history.

(56) References Cited

U.S. PATENT DOCUMENTS

2018/0135387 A1* 5/2018 Older ..... E21B 43/36

FOREIGN PATENT DOCUMENTS

CN 1294648 A 5/2001
CN 1587642 A 3/2005
(Continued)

*Primary Examiner* — David J Bagnell
*Assistant Examiner* — Dany E Akakpo
(74) *Attorney, Agent, or Firm* — Darrin A. Auito; HEA Law PLLC

(57) ABSTRACT

A method for recovering gas in natural gas hydrate exploitation is disclosed, in which a gas-water mixture at a bottom of a exploitation well is delivered to an ocean surface platform through a marine riser, by adopting the gas-lift effect of methane gas derived from the dissociation of natural gas hydrate, so as to achieve a controllable flowing production of marine natural gas hydrate. In the startup stage, the pressure in the bottom of the well is decreased by the gas-lift effect of the injected gas to allow dissociation of the hydrate. In the flowing production stage, the flowing production is achieved by the gas-lift effect of the gas derived from the dissociation of the natural gas hydrate,
(Continued)

wherein a seafloor gas tank is employed to control the flowing rate and replenish the consumed gas.

7 Claims, 2 Drawing Sheets

(51) Int. Cl.
*E21B 43/16* (2006.01)
*E21B 43/01* (2006.01)

(56) References Cited

FOREIGN PATENT DOCUMENTS

| | | | |
|---|---|---|---|
| CN | 105064959 | A | 11/2015 |
| CN | 105587303 | A | 5/2016 |

* cited by examiner

METHOD AND SYSTEM FOR RECOVERING GAS IN NATURAL GAS HYDRATE EXPLOITATION

CROSS REFERENCE TO RELATED APPLICATIONS

This application is a National Stage of International Application No. PCT/CN2018/076449 filed on Feb. 12, 2018. The contents of the above document is incorporated herein by reference in its entirety.

FIELD OF THE INVENTION

The present invention relates to the field of energy technology, particularly to a method for recovering gas in marine natural gas hydrate exploitation, and more particularly to a delivery system and a control method for recovering gas in marine natural gas hydrate exploitation.

BACKGROUND OF THE INVENTION

Natural gas hydrate (or "gas hydrate", for short), is an ice-like, non-stoichiometric clathrate compound, which is formed by the combination of water and hydrocarbons having low molecular weights in the natural gas under low temperature and high pressure. Naturally occurring gas hydrate is mainly methane hydrate, which mostly occurs under the seafloor and has a few advantages such as its large quantities, wide distribution, shallow occurrence, high energy density, and residue- and pollution-free burning. One unit volume of methane hydrate produces 150 to 180 unit volumes of methane gas after dissociation. It is estimated that, natural gas hydrate represents 53% of the global organic carbon reservoir, two times of the total amount of the three fossil fuels (coal, oil and natural gas). Thus, natural gas hydrate has been considered as an ideal clean alternative energy in the $21^{st}$ century.

Natural gas hydrate, occurring in solid form in loose sediments of muddy sea bottom, will undergo a phase transition during its exploitation, and thus huge difficulties in gas hydrate exploitation exist compared with oil and natural gas exploitations. Depending on where the gas hydrate dissociates, there are two kinds of gas hydrate exploitation, underground dissociation exploitation and above-ground dissociation exploitation.

The above-ground dissociation exploitation is mainly applied to shallow and non-diagenetic hydrate reservoirs. Chinese patent CN1294648A discloses a method in which high pressure air is introduced to the natural gas hydrate reservoir and the solid gas hydrate is carried over in a flow to the ocean surface. Chinese patent CN1587642A discloses a process based on the onshore mining method, in which solid gas hydrate is extracted by underwater automatic excavators, and then recovered by silt separation and gas hydrate dissociation. Chinese patent CN105587303A discloses a green method and device for exploitation of shallow and non-diagenetic gas hydrate reservoirs at seafloor. CN105064959A discloses a green method for exploitation of seafloor non-diagenetic gas hydrate reservoirs, in which solid gas hydrate is extracted through submarine mining, and after a secondary crushing the solid particles of gas hydrate is mixed with seawater in a confined room to discompose it into natural gas and water utilizing the heat of the seawater from the ocean surface, and then lift to the ocean surface by airlift effect. All the above methods for above-ground dissociation exploitation have problems such as their limited applicability, high technical demand on underwater automatic mining machines, difficult implementation, and huge damages to seafloor geological structure which will cause well collapses or landslides.

Most researches and reports focus on underground dissociation exploitation mainly based on exploitation techniques of oil and natural gas, in which a wellbore is constructed in the seafloor stratum, and specific methods will be adopted to change the thermodynamic conditions, such as temperature and pressure, to precipitate an in-situ dissociation of the natural gas hydrate into water and natural gas. The water and the natural gas are collected and separated, and then delivered to the ocean surface through a marine riser. Methods for underground dissociation exploitation include thermal stimulation, depressurization, and chemical method. At present, most researches of underground dissociation exploitation focus on how to dissociate the gas hydrate in situ in the stratum through an economical, safe and efficient method. In contrast, fewer researches focus on how to deliver the mixture of gas, water and sand from the well bottom to the platform at the ocean surface. In the first producing test of marine natural gas hydrate at Naikai Through, Japan in 2013, electric submersible pumps were adopted to pump the gas-water mixture from the well bottom through the exploitation well to a gas-liquid separator, and then the separated gas phase and water phase were delivered to the ocean surface separately through two marine risers. In the producing test of natural gas hydrate by China Geological Survey at Shenhu Area of South China Sea in 2017, high power electric submersible pumps were adopted to deliver the geological fluid of gas-water mixture in the hydrate layer through exploitation well and marine riser, and then the mixture were dissociated into methane gas and water. These methods of recovering the gas by adopting electric submersible pumps have a high cost, due to the high energy consumption and short operation life of electric submersible pumps. Thus, there is a need to develop an economical and efficient technology for delivering the gas in natural gas hydrate exploitation, which can be applied in exploiting marine natural gas hydrate resource.

SUMMARY OF THE INVENTION

In view of the above concerns, one object of the present invention is to provide a method and a system for recovering gas in natural gas hydrate exploitation, which are economical and efficient.

The present invention is implemented by the following technical solutions:

A method for recovering gas in natural gas hydrate exploitation, in which a gas-water mixture at a bottom of a exploitation well is delivered to a ocean surface platform through a marine riser, by adopting the gas-lift effect of methane gas derived from the dissociation of natural gas hydrate, so as to achieve a controllable flowing production ("flowing" herein means that a well is capable of producing oil or gas without the aid of a pump) of marine natural gas hydrate, comprises the following steps:

Step 1, startup stage: injecting a certain amount of nitrogen gas or methane gas into a seafloor gas tank by a compressor and allowing a pressure therein to be higher than a seafloor static pressure; opening an automatic control gate valve between a well head assembly and a marine riser, and an automatic control gate valve between the seafloor gas tank and a bottom of the marine riser; injecting the gas from the seafloor gas tank to the marine riser, and lifting liquid from a bottom of the well to the ocean surface platform by the gas-lift effect of the gas, so as to decrease a pressure of a seafloor hydrate layer to below a phase equilibrium pressure of the hydrate and thereby the hydrate in the seafloor hydrate layer is dissociated into methane gas and water; the gas-water mixture is driven to flow into the exploitation well by a pressure of a hydrate reservoir.

Step 2, flowing production stage: online detecting a liquid-gas ratio of a gas-liquid fluid produced from the hydrate reservoir by a sensor;

if the liquid-gas ratio is larger than a flowing liquid-gas ratio of the gas-liquid fluid, then adding gas from the seafloor gas tank to the marine riser;

if the liquid-gas ratio is smaller than the flowing liquid-gas ratio of the gas-liquid fluid, then closing the valve between the seafloor gas tank and the marine riser to stop gas supply, opening a valve between a seafloor gas-liquid cyclone separator and the marine riser to divert a portion of the gas-liquid fluid to the seafloor gas-liquid cyclone separator, adding gas separated therefrom to the seafloor gas tank after pressurizing by a booster pump to replenish the consumed gas, and returning a residual of the gas-liquid fluid to the bottom of the marine riser;

after the gas-liquid fluid is lifted by its own force to the ocean surface platform, separating the gas-liquid fluid by a gas-liquid separator, wherein the water produced is discharged, and the methane gas produced is stored in a gas tank and transported away.

In an improvement of the above solution, the flowing liquid-gas ratio of the gas-liquid fluid increases as a production pressure at the bottom of the well increases; when provided the same production pressure, the flowing liquid-gas ratio of the gas-liquid fluid increases as the water depth decreases.

In another improvement of the above solution, the method for recovering gas can be applied in methods for marine natural gas hydrate exploitation, including depressurization method, thermal stimulation method, chemical agent injection method, and $CO_2$ replacement method.

A system for recovering gas in natural gas hydrate exploitation, comprises an ocean surface platform, a gas-liquid separator, a gas tank, a compressor, a seafloor gas tank, a booster pump, a seafloor gas-liquid cyclone separator, a gas buffer tank, a marine riser, a well head assembly, and an exploitation well; the ocean surface platform is disposed above the ocean surface; the gas-liquid separator, the gas tank and the compressor are disposed on the ocean surface platform; the exploitation well is disposed vertically above a seafloor stratum, and penetrates a seafloor sediment layer and a natural gas hydrate layer; a top of the exploitation well is connected with the well head assembly; a bottom of the marine riser is connected with the well head assembly through a first valve; a top of the marine riser is connected sequentially with the gas-liquid separator, the gas tank and the compressor through pipelines; the seafloor gas tank, the booster pump, the seafloor gas-liquid cyclone separator and the gas buffer tank are disposed beside the well head assembly; a gas-liquid mixture inlet of the seafloor gas-liquid cyclone separator is connected with the well head assembly through pipelines and a second valve; a liquid outlet of the seafloor gas-liquid cyclone separator is connected with the bottom of the marine riser through pipelines and a third valve; a gas outlet of the seafloor gas-liquid cyclone separator is connected sequentially with the gas buffer tank, the booster pump, a fourth valve and the seafloor gas tank through pipelines; the seafloor gas tank is connected with the compressor through a pipeline; the seafloor gas tank is connected with the bottom of the marine riser through pipelines and a fifth valve.

In an improvement of the above solution, a ball valve is disposed between the seafloor gas tank and the compressor.

In another improvement of the above solution, a sand control device is disposed in the exploitation well.

In another improvement of the above solution, the first valve, the second valve, the third valve, the fourth valve and the fifth valve are seafloor automatic gate valves. The present invention has the following advantages:

(1) By adopting the gas-lift effect of methane gas, the gas-liquid mixture derived from the dissociation of natural gas hydrate is delivered from the bottom of the exploitation well to the ocean surface platform, and thereby the energy consumption of the gas recovery is significantly decreased. Compared with those methods of lifting the product by electric submersible pumps, pressure proof rotating equipment for subsea condition is not required in the present invention resulting in a simplified process and a lower requirement on the equipment.

(2) As disclosed above, if the liquid-gas ratio of the produced fluid is smaller than the flowing liquid-gas ratio of the gas-liquid fluid, gas is collected and stored by the seafloor gas-liquid separator and the seafloor gas tank; if the liquid-gas ratio of the produced fluid is larger than the flowing liquid-gas ratio of the gas-liquid fluid, gas is added from the seafloor gas tank to the marine riser. In this way, the requirement of flowing production is satisfied. Such method allows control of the flowing rate when the gas-liquid ratio is high and can satisfy the requirement of flowing production when the gas-liquid ratio is small. Thereby the energy consumption for gas-lifting is decreased and the stability of the flowing production is improved.

(3) Compared with those methods of using electric submersible pumps, the present invention makes full use of the gas-lift effect of dissociated gas to deliver the gas-liquid fluid, such that the pressure of the gas-liquid fluid in the marine riser is much lower, which can avoid re-formation of hydrate from the gas-liquid fluid in the marine riser and the resulting blockage. If an electric submersible pump is adopted for the delivery, due to the pressurization effect of the pump, the pressure in the marine riser will be increased to above the phase equilibrium pressure of hydrate formation, which will result in a re-formation of hydrate and a blockage in the marine riser.

(4) In the method of the present invention, process and equipment are simple and easy to operate, energy consumption and cost are low, seafloor rotating equipment is not required, industrial and automatic production is achieved. The present invention has wide applicability, can avoid the blockage by re-formation of hydrate in the marine riser, and can be applied in marine natural gas hydrate exploitation including depressurization method, thermal stimulation method, chemical agent injection method, and CO2 replacement method. Thus, the present invention has large market potential.

DETAILED DESCRIPTION OF THE EMBODIMENTS

Embodiment 1

Figure 1:
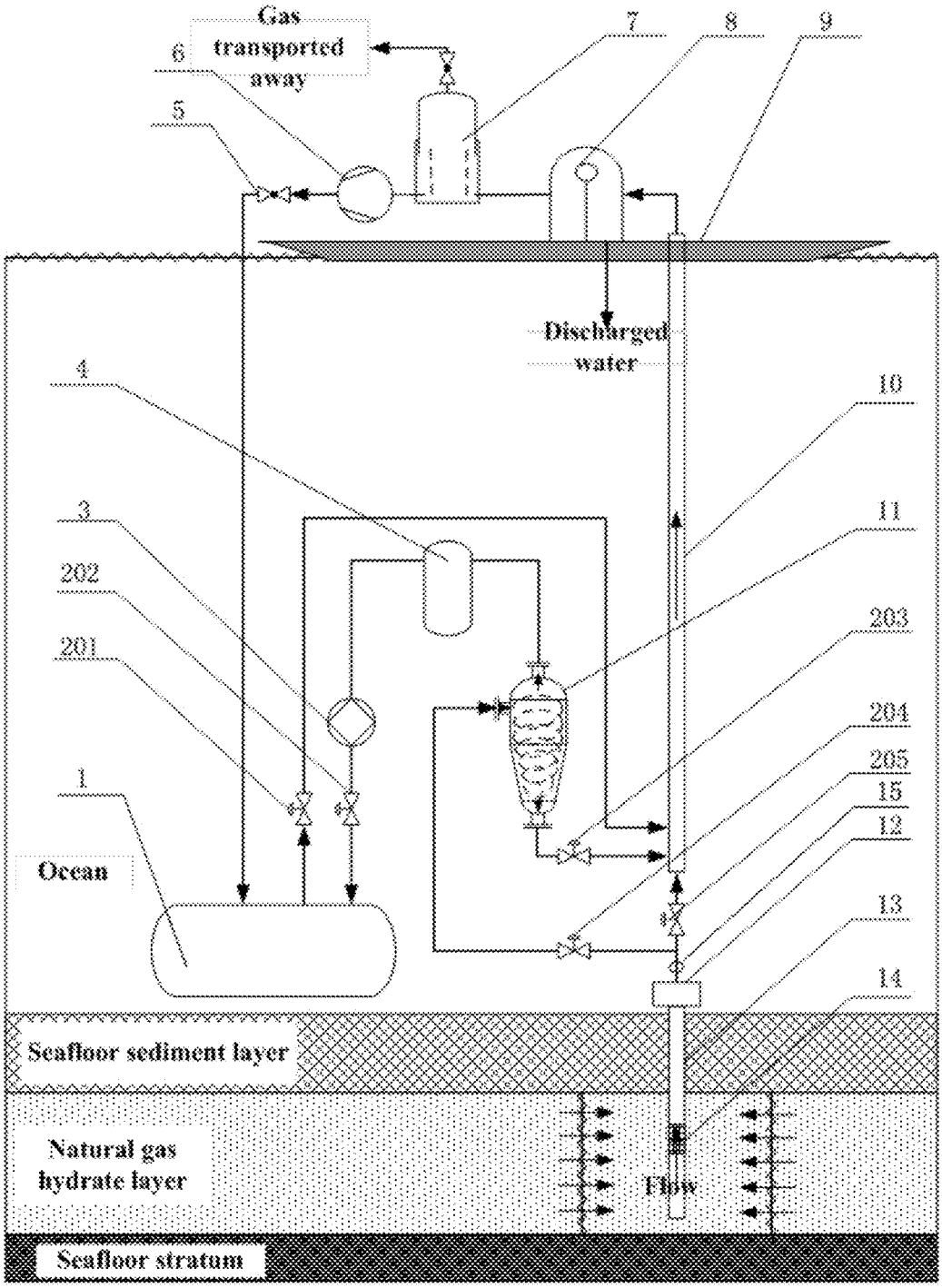
FIG. 1 shows a schematic diagram of a system of the present invention.

As shown in FIG. 1, an ocean surface platform 9 is set up using prior art technology where a marine gas hydrate reservoir is located. A vertical exploitation well 13 is drilled above a seafloor stratum and penetrates a seafloor sediment layer and a natural gas hydrate layer. A sand control device 14 is disposed in the exploitation well. The top of the exploitation well is connected with a well head assembly 12. Also provided is a marine riser 10. The bottom of the marine riser 10 is connected with a well head assembly 12 through a seafloor automatic gate valve 205. The top of the marine riser 10 is connected sequentially through pipelines with a gas-liquid separator 8, a gas tank 7 and a compressor 6 which are disposed on the ocean surface platform 9. a seafloor gas tank 1, a seafloor gas-liquid cyclone separator 11, a gas buffer tank 4 and a booster pump 3 are disposed beside the well head assembly 12. A gas-liquid mixture inlet of the seafloor gas-liquid cyclone separator 11 is connected with the well head assembly 12 through pipelines and a seafloor automatic gate valve 204. A liquid outlet of the seafloor gas-liquid cyclone separator 11 is connected with the bottom of the marine riser 10 through pipelines and a seafloor automatic gate valve 203. A gas outlet at the top of the seafloor gas-liquid cyclone separator 11 is connected sequentially through pipelines with the gas buffer tank 4, the booster pump 3, a seafloor automatic gate valve 202 and the top of the seafloor gas tank 1. The seafloor gas tank 1 is connected through a pipeline with the compressor 6 disposed on the ocean surface platform 9. The seafloor gas tank 1 is connected with the bottom of the marine riser 10 through pipelines and a seafloor automatic gate valve 201.

When the hydrate exploitation is performed via the depressurization method, a certain amount of nitrogen gas or methane gas is first injected into the seafloor gas tank 1 by a compressor 6 so as to allow the pressure therein to be higher than the seafloor static pressure. Then the seafloor automatic gate valves 205 and 201 are opened, and the gas is injected from the seafloor gas tank 1 to the bottom of the marine riser 10. The gas will go upwards by its own buoyancy after injected into the marine riser 10 and lift the liquid from the bottom of the exploitation well 13 to the ocean surface platform by the gas-lift effect, so as to decrease the pressure in the bottom of the well and the pressure of the seafloor hydrate layer to below a phase equilibrium pressure of the hydrate, and thereby the hydrate at the seafloor hydrate layer is dissociated into methane gas and water which will be driven to flow into the bottom of the exploitation well 13 by the pressure-gradient force of the hydrate reservoir.

When the amount of the water and methane gas produced from the seafloor hydrate layer reaches a certain value, the gas-liquid fluid produced from the hydrate reservoir can flow to the ocean surface platform 9 through the marine riser 10 under the gas-lift effect of the methane gas therein. Then the seafloor automatic gate valve 201 between the seafloor gas tank 1 and the marine riser 10 is closed so as to stop injecting the gas, and thereby the hydrate exploitation enters the flowing production stage.

In the flowing production stage, a liquid-gas ratio of the gas-liquid fluid produced from the hydrate reservoir is detected online by a sensor 15.

If the liquid-gas ratio is larger than a flowing liquid-gas ratio of the gas-liquid fluid, then the seafloor automatic gate valve 201 is opened to add gas from the seafloor gas tank 1 to the bottom of the marine riser 10. If the liquid-gas ratio is smaller than the flowing liquid-gas ratio of the gas-liquid fluid, then the seafloor automatic gate valve 201 is closed to stop gas supply, and the seafloor automatic gate valves 202, 203 and 204 are opened to divert a portion of the gas-liquid fluid to the seafloor gas-liquid cyclone separator 11. Gas separated therefrom is added to the seafloor gas tank 1 after pressurized by the gas buffer tank 4 and the booster pump 3 to replenish the consumed gas, and a residual of the gas-liquid fluid is returned to the bottom of the marine riser 10. The gas-liquid fluid is then lifted by its own force to the ocean surface platform.

After the gas-liquid fluid flows to the ocean surface platform is separated by the gas liquid separator 8, the water produced is discharged, and the methane gas produced is stored in a gas tank 7 and transported away.

Figure 2:
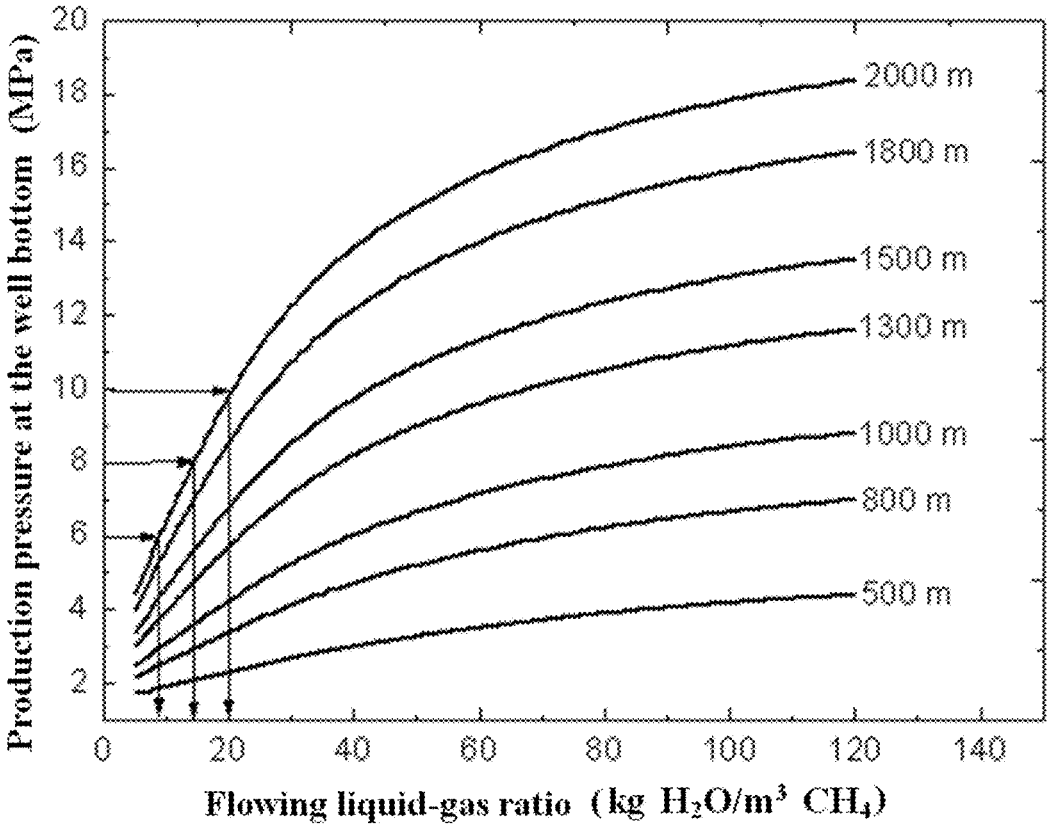
FIG. 2 shows the relationship between the production pressure at the bottom of the well and the flowing liquid-gas ratio.

As shown in FIG. 2, for a natural gas hydrate reservoir at the depth of 2000 meters (which is a sum of the lengths of the marine riser and the production well) provided with a marine riser having an internal diameter of 200 millimeters, when the recovery rate of the gas-liquid fluid is 37.5 kg/s, if a production pressure of 8.0 MPa is employed at the bottom of the well, then the flowing liquid-gas ratio is 13.5 kg $H_2O/m^3$ $CH_4$, and therefore we shall control the liquid-gas ratio of the fluid at the bottom of the marine riser 10 to below 13.5 kg $H_2O/m^3$ $CH_4$ to allow the flowing production. If a production pressure of 6.0 MPa is employed at the bottom of the well, then the flowing liquid-gas ratio is 9 kg $H_2O/m^3$ $CH_4$, and therefore we shall control the liquid-gas ratio of the fluid at the bottom of the marine riser 10 to below 9 kg $H_2O/m^3$ $CH_4$ to allow the flowing production.

The above is a detailed description of a feasible embodiment of the present invention, which is not used to limit the present invention. Any equivalent embodiment or modification that not departs from the spirit of the present invention shall fall within the scope of the present invention.

The invention claimed is:

1. A method for recovering gas in natural gas hydrate exploitation, characterized in that, a gas-water mixture at a bottom of an exploitation well is delivered to an ocean surface platform through a marine riser by adopting the gas-lift effect of methane gas derived from dissociation of natural gas hydrate, so as to achieve a controllable flowing production of marine natural gas hydrate, the method comprises the following steps:

step 1, startup stage: injecting a certain amount of nitrogen gas or methane gas into a seafloor gas tank by a compressor and allowing a pressure therein to be higher than a seafloor static pressure; opening an automatic control gate valve between a well head assembly and the marine riser, and an automatic control gate valve between the seafloor gas tank and a bottom of the marine riser; injecting the gas from the seafloor gas tank to the marine riser, and lifting liquid from a bottom of the well to the ocean surface platform by the gas-lift effect of the gas, so as to decrease a pressure of a seafloor hydrate layer to below a phase equilibrium pressure of the hydrate and thereby the hydrate in the seafloor hydrate layer is dissociated into methane gas and water; the gas-water mixture is driven to flow into the exploitation well by a pressure of a hydrate reservoir;

step 2, flowing production stage: online detecting a liquid-gas ratio of a gas-liquid fluid produced from the hydrate reservoir by a sensor;

if the liquid-gas ratio is larger than a flowing liquid-gas ratio of the gas-liquid fluid, then adding gas from the seafloor gas tank to the marine riser;

if the liquid-gas ratio is smaller than the flowing liquid-gas ratio of the gas-liquid fluid, then closing the valve between the seafloor gas tank and the marine riser to stop gas supply, opening a valve between a seafloor gas-liquid cyclone separator and the marine riser to divert a portion of the gas-liquid fluid to the seafloor gas-liquid cyclone separator, adding gas separated therefrom to the seafloor gas tank after pressurizing by a booster pump to replenish the consumed gas, and returning a residual of the gas-liquid fluid to the bottom of the marine riser;

after the gas-liquid fluid is lifted by its own force to the ocean surface platform, separating the gas-liquid fluid by a gas-liquid separator, wherein the water produced is discharged, and the methane gas produced is stored in a gas tank and transported away.

2. The method according to claim 1, characterized in that, the flowing liquid-gas ratio of the gas-liquid fluid increases as a production pressure at the bottom of the well increases; when provided the same production pressure, the flowing liquid-gas ratio of the gas-liquid fluid increases as the water depth decreases.

3. The method according to claim 1, characterized in that, the method for recovering gas can be applied in methods for marine natural gas hydrate exploitation including depressurization method, thermal stimulation method, chemical agent injection method, and CO2 replacement method.

4. A system for recovering gas in natural gas hydrate exploitation, characterized in that, the system comprises an ocean surface platform, a gas-liquid separator, a gas tank, a compressor, a seafloor gas tank, a booster pump, a seafloor gas-liquid cyclone separator, a gas buffer tank, a marine riser, a well head assembly, and an exploitation well;

the ocean surface platform is disposed above the ocean surface;

the gas-liquid separator, the gas tank and the compressor are disposed on the ocean surface platform;

the exploitation well is disposed vertically above a seafloor stratum, and penetrates a seafloor sediment layer and a natural gas hydrate layer;

a top of the exploitation well is connected with the well head assembly;

a bottom of the marine riser is connected with the well head assembly through a first valve;

a top of the marine riser is connected sequentially through pipelines with the gas-liquid separator, the gas tank and the compressor which are disposed on the ocean surface platform;

the seafloor gas tank, the booster pump, the seafloor gas-liquid cyclone separator and the gas buffer tank are disposed beside the well head assembly;

a gas-liquid mixture inlet of the seafloor gas-liquid cyclone separator is connected with the well head assembly through pipelines and a second valve;

a liquid outlet of the seafloor gas-liquid cyclone separator is connected with the bottom of the marine riser through pipelines and a third valve;

a gas outlet of the seafloor gas-liquid cyclone separator is connected sequentially with the gas buffer tank, the booster pump, a fourth valve and the seafloor gas tank through pipelines;

the seafloor gas tank is connected with the compressor through a pipeline;

the seafloor gas tank is connected with the bottom of the marine riser through pipelines and a fifth valve.

5. The system according to claim 4, characterized in that, a ball valve is disposed between the seafloor gas tank and the compressor.

6. The system according to claim 4, characterized in that, a sand control device is disposed in the exploitation well.

7. The system according to claim 4, characterized in that, the first valve, the second valve, the third valve, the fourth valve and the fifth valve are seafloor automatic gate valves.

* * * * *